US006525015B2

(12) United States Patent
Man et al.

(10) Patent No.: US 6,525,015 B2
(45) **Date of Patent: *Feb. 25, 2003**

(54) DETERGENT COMPOSITION AND METHOD FOR REMOVING SOIL

(75) Inventors: Victor F. Man, St. Paul, MN (US); Terrence P. Everson, Eagan, MN (US); Steven E. Lentsch, St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/118,577

(22) Filed: Apr. 8, 2002

(65) Prior Publication Data

US 2002/0155978 A1 Oct. 24, 2002

Related U.S. Application Data

(63) Continuation of application No. 09/307,393, filed on May 7, 1999, now Pat. No. 6,369,021.

(51) Int. Cl.[7] ..... C11D 1/82; C11D 9/36

(52) U.S. Cl. ..... 510/466; 510/225; 510/228; 510/230; 510/238; 510/239; 510/240; 510/294; 510/298; 510/310; 510/356; 510/360; 510/361; 510/374; 510/439; 510/441; 510/446; 510/469; 510/475; 510/478; 510/533; 134/25.2; 134/42; 8/137

(58) Field of Search ..... 510/222, 223, 510/225, 227, 228, 230, 238–240, 294, 298, 302, 310, 339, 349, 356, 360, 361, 367, 379, 421, 434, 435, 439, 441, 446, 466, 469, 475, 478, 533; 134/25.2, 42; 8/137

(56) References Cited

U.S. PATENT DOCUMENTS

| | | | | |
|---|---|---|---|---|
| 2,164,092 | A | 6/1939 | Smith | 23/107 |
| 2,382,103 | A | 8/1945 | MacMahon | 252/138 |
| 2,559,583 | A | 7/1951 | Barker | 252/152 |
| 2,559,584 | A | 7/1951 | Barker | 252/152 |
| 2,561,392 | A | 7/1951 | Marshall | 117/100 |
| 2,584,056 | A | 1/1952 | Soule et al. | 252/106 |
| 2,584,057 | A | 1/1952 | Soule et al. | 252/106 |
| 2,665,256 | A | 1/1954 | Barker | 252/152 |
| 2,824,091 | A | 2/1958 | Desty et al. | 260/96.5 |
| 3,046,232 | A | 7/1962 | Bonewitz | 252/156 |

(List continued on next page.)

FOREIGN PATENT DOCUMENTS

| | | |
|---|---|---|
| EP | 0 163 352 A2 | 12/1985 |
| EP | 0 234 082 A1 | 9/1987 |
| EP | 0 266 200 A3 | 5/1988 |

(List continued on next page.)

OTHER PUBLICATIONS

Product Brochure entitled "ACUSOL® Detergent Polymers", *Rohm & Haas*, 6 pgs. (Aug. 1992).

(List continued on next page.)

*Primary Examiner*—Yogendra N. Gupta
*Assistant Examiner*—Brian P. Mruk
(74) *Attorney, Agent, or Firm*—Merchant & Gould P.C.

(57) ABSTRACT

The invention relates to a highly alkaline or mildly alkaline detergent composition having enhanced cleaning properties. The detergent combines a source of alkalinity and a blend of nonionic surfactants that enhances cleaning starchy soils. The blend of nonionic surfactants preferably includes an alkyl polyglycoside surfactant and a silicon surfactant having a hydrophobic silicon group and a pendant hydrophilic group. Preferably, the blend of nonionic surfactants includes a surfactant having a hydrophobic group and an ethylene oxide residue containing group and a polymer additive. A method for removing soil from an article is provided.

41 Claims, 1 Drawing Sheet

U.S. PATENT DOCUMENTS

| | | | | |
|---|---|---|---|---|
| 3,066,354 | A | 12/1962 | Chaffee et al. | 18/47.5 |
| 3,233,986 | A | 2/1966 | Morehouse | 44/76 |
| 3,324,038 | A | 6/1967 | Chaffee et al. | 252/152 |
| 3,342,740 | A | 9/1967 | Kazmierczak et al. | 252/153 |
| 3,366,571 | A | 1/1968 | Cooper et al. | 252/99 |
| 3,398,219 | A | 8/1968 | Kelly et al. | 264/102 |
| 3,554,915 | A | 1/1971 | Keay et al. | 252/99 |
| 3,741,913 | A | 6/1973 | Stenungsund | 252/544 |
| 3,746,653 | A | 7/1973 | Churchfield | 252/321 |
| 3,803,285 | A | 4/1974 | Jensen | 264/143 |
| 3,858,854 | A | 1/1975 | Win et al. | 252/89 |
| 3,894,466 | A | 7/1975 | Wibrow | 85/10 F |
| 3,957,661 | A | 5/1976 | Verite | 252/8.9 |
| 3,962,119 | A | 6/1976 | Cosentino et al. | 252/351 |
| 4,105,573 | A | 8/1978 | Jacobsen | 510/222 |
| 4,119,578 | A | 10/1978 | Deninckx et al. | 252/548 |
| 4,136,045 | A | 1/1979 | Gault et al. | 510/452 |
| 4,203,857 | A | 5/1980 | Dugan | 252/92 |
| 4,219,435 | A | 8/1980 | Biard et al. | 252/90 |
| 4,219,436 | A | 8/1980 | Gromer et al. | 252/135 |
| 4,242,217 | A | 12/1980 | Westermann et al. | 252/135 |
| 4,265,777 | A | 5/1981 | Boyer et al. | 252/113 |
| 4,289,525 | A | 9/1981 | Pasarela et al. | 71/92 |
| 4,370,250 | A | 1/1983 | Joshi | 252/135 |
| 4,427,558 | A | 1/1984 | David | 252/8.8 |
| 4,510,110 | A | 4/1985 | Mazzoni | 264/176 R |
| 4,517,107 | A | 5/1985 | Clarke et al. | 252/108 |
| 4,541,831 | A | 9/1985 | Gunther et al. | 8/648 |
| 4,569,780 | A | 2/1986 | Fernholz et al. | 252/90 |
| 4,569,781 | A | 2/1986 | Fernholz et al. | 252/92 |
| 4,587,029 | A | 5/1986 | Brooks | 252/91 |
| 4,601,844 | A | 7/1986 | Cilley | 252/95 |
| 4,615,819 | A | 10/1986 | Leng et al. | 252/110 |
| 4,624,713 | A | 11/1986 | Morganson et al. | 134/25.2 |
| 4,654,161 | A | 3/1987 | Kollmeier et al. | 252/174.15 |
| 4,722,802 | A | 2/1988 | Hutchings et al. | 252/174 |
| 4,725,376 | A | 2/1988 | Copeland | 252/90 |
| 4,753,755 | A | 6/1988 | Gansser | 252/527 |
| 4,753,844 | A | 6/1988 | Jones et al. | 428/288 |
| RE32,818 | E | 1/1989 | Fernholz et al. | 252/90 |
| 4,798,724 | A | 1/1989 | Khanna | 424/480 |
| 4,818,421 | A | 4/1989 | Boris et al. | 252/8.8 |
| 4,820,440 | A | 4/1989 | Hemm et al. | 252/138 |
| 4,820,449 | A | 4/1989 | Menke et al. | 252/544 |
| 4,822,854 | A | 4/1989 | Ciolino | 252/174.19 |
| 4,846,989 | A | 7/1989 | Killa | 252/99 |
| 4,861,518 | A | 8/1989 | Morganson et al. | 252/548 |
| 4,879,051 | A | 11/1989 | Lo et al. | 252/8.75 |
| 4,879,063 | A | 11/1989 | Wood-Rethwill et al. | 252/370 |
| 4,919,838 | A | 4/1990 | Tibbetts et al. | 252/117 |
| 4,931,202 | A | 6/1990 | Cotter et al. | 252/99 |
| 4,933,100 | A | 6/1990 | Ramachandran | 252/95 |
| 4,933,102 | A | 6/1990 | Olson | 252/174 |
| 4,960,533 | A | 10/1990 | Wisniewski et al. | 252/142 |
| 4,971,714 | A | 11/1990 | Lokkesmoe et al. | 252/95 |
| 4,978,471 | A | 12/1990 | Starch | 252/174.15 |
| 5,019,346 | A | 5/1991 | Richter et al. | 422/28 |
| 5,030,376 | A | 7/1991 | Lee et al. | 252/108 |
| 5,061,392 | A | 10/1991 | Bruegge et al. | 252/135 |
| 5,064,554 | A | 11/1991 | Jacobs et al. | 252/99 |
| 5,064,561 | A | 11/1991 | Rouillard | 252/174.12 |
| 5,066,425 | A | 11/1991 | Ofosu-Asante et al. | 252/546 |
| 5,156,794 | A | 10/1992 | Nakanishi et al. | 264/349 |
| 5,198,198 | A | 3/1993 | Gladfelter et al. | 422/264 |
| 5,234,615 | A | 8/1993 | Gladfelter et al. | 252/90 |
| 5,254,284 | A | 10/1993 | Barone et al. | 252/174.15 |
| 5,318,728 | A | 6/1994 | Surutzidis et al. | 252/548 |
| 5,382,377 | A | 1/1995 | Raehse et al. | 252/174 |
| 5,397,506 | A | 3/1995 | Groth et al. | 252/547 |
| 5,407,598 | A | 4/1995 | Olson et al. | 252/186.35 |
| 5,437,809 | A | 8/1995 | Chaudhuri | 252/174.15 |
| 5,439,609 | A | 8/1995 | Paszek | 252/174.15 |
| 5,474,698 | A | 12/1995 | Rolando | 252/90 |
| 5,500,154 | A | 3/1996 | Bacon et al. | 252/551 |
| 5,501,815 | A | 3/1996 | Man | 252/174.17 |
| 5,536,436 | A | 7/1996 | Pramod | 510/321 |
| 5,543,082 | A | 8/1996 | McGee et al. | 252/321 |
| 5,560,748 | A | 10/1996 | Surutzidis et al. | 8/11 |
| 5,589,099 | A | 12/1996 | Baum | 510/514 |
| 5,603,776 | A | 2/1997 | Lentsch et al. | 134/25.2 |
| 5,786,320 | A | 7/1998 | Urfer et al. | 510/470 |
| 5,880,088 | A | 3/1999 | Lentsch et al. | 510/514 |
| 5,880,089 | A | 3/1999 | Lentsch et al. | 510/514 |
| 5,965,507 | A * | 10/1999 | Thoen et al. | 510/320 |
| 6,008,178 | A | 12/1999 | Baillely et al. | 510/392 |
| 6,060,444 | A | 5/2000 | Schulz et al. | 510/451 |
| 6,164,296 | A | 12/2000 | Lentsch et al. | 134/25.2 |
| 6,258,765 | B1 | 7/2001 | Wei et al. | 510/224 |
| 6,369,021 | B1 | 4/2002 | Man et al. | 510/466 |

FOREIGN PATENT DOCUMENTS

| | | | | |
|---|---|---|---|---|
| EP | 0 282 214 | B1 | 9/1988 | |
| EP | 0 312 278 | A3 | 4/1989 | |
| EP | 0 432 836 | A2 | 6/1991 | |
| EP | 0 786 515 | A2 | 7/1997 | |
| EP | 786515 | A2 * | 7/1997 | C11D/1/86 |
| EP | 0 953 631 | A1 | 11/1999 | |
| GB | 1 553 610 | | 10/1979 | |
| GB | 2 106 928 | A | 4/1983 | |
| GB | 2 200 365 | A | 8/1988 | |
| GB | 2 245 908 | A | 1/1992 | |
| JP | 63-168500 | | 7/1988 | |
| WO | WO 93/07245 | | 4/1993 | |
| WO | WO 94/07980 | | 4/1994 | |
| WO | WO 95/18212 | | 7/1995 | |
| WO | WO 96/00274 | | 1/1996 | |
| WO | WO 96/08553 | | 3/1996 | |
| WO | WO 98/30662 | | 7/1998 | |

OTHER PUBLICATIONS

Product Brochure entitled "Fluorad™ Fluorochemical Surfactants", *3M*, 7 pgs. (1993). No Month Given.

Product Brochure entitled "Fluorad™ Fluorochemical Surfactant FC–170C", *3M*, 3 pgs. (1993). No Month Given.

Product Brochure entitled "SILWET® Surfactants", *Union Carbide Chemicals and Plastics Company Inc.*, 23 pgs. (Apr. 1993).

Product Description entitled "ABIL® B 8842—ABIL® B 88183: ABIL® Polyether Polysiloxane Copolymers", *Goldschmidt Chemical Corporation*, 2 pgs. (Jul. 1989).

Product Description entitled "GLUCOPON® Surfactant Products", *Henkel*, 3 pgs. (Date unknown). No Date Given.

* cited by examiner

DETERGENT COMPOSITION AND METHOD FOR REMOVING SOIL

This application is a continuation of application Ser. No. 09/307,393, that was filed with the United States Patent and Trademark Office on May 7, 1999, and issued as U.S. Pat. No. 6,369,021 on Apr. 9, 2002.

FIELD OF THE INVENTION

The invention relates to a laundry, warewashing, CIP, hard surface, etc. detergent composition that can take the form of a powder, pellet, brick or solid block detergent. Each physical embodiment of the detergent composition can be packaged in an appropriate packaging system for distribution and sale. Typically, the detergent composition contains a source of alkalinity and an improved surfactant package that substantially improves soil removal and particularly improves soil removal of starchy, waxy-fatty, and protein soils common in a number of soil locations. The detergent composition is particularly suited for use in industrial warewashing applications.

The invention also relates to an alkaline warewashing detergent composition in the form of a flake, powder, pellet, block, etc., using a blend of surfactants to enhance cleaning properties. More specifically, the invention relates to an alkaline cleaning system that contains a source of alkalinity, a cooperating blend of surfactants and other cleaning materials that can substantially increase the cleaning capacity, relating to starchy, waxy-fatty, and protein soils. The detergent can also contain a variety of other chemical agents including polymeric additives, water softening agents, sanitizers, sequestrants, anti-redeposition agents, defoaming agents, etc. useful in detergent compositions.

BACKGROUND OF THE INVENTION

Detergent compositions comprising a source of alkalinity, a surfactant or surfactant package combined with other general washing chemicals have been known for many years. Such materials have been used in laundry products, warewashing compositions, CIP cleaners, and hard surface cleaners. Virtually any cleaner containing a source of alkalinity that is designed or formulated for dilution into an aqueous based composition can be used within this broad general concept. Powder dishwasher detergents are disclosed in, for example, in Dos et al., U.S. Pat. No. 3,956,199, Dos et al., U.S. Pat. No. 3,963,635. Further, Macmullen et al., U.S. Pat. No. 3,032,578 teach alkaline dishwashing detergents containing a chlorine source, an organic phosphonate, a surfactant composition and a water treating agent. Similarly, Almsted et al., U.S. Pat. No. 3,351,557, Davis et al, U.S. Pat. No. 3,341,459, Zimmerman et al., U.S. Pat. Nos. 3,202,714 and 3,281,368 teach built liquid laundry detergent comprising a source of alkalinity and nonionic surfactant materials.

Powdered general purpose, warewashing and laundry detergents have been used for many years. The manufacture and use of solid block cleaning compositions were pioneered in technology disclosed in Fernholz et al., U.S. Reissue Pat. Nos. 32,763 and 32,818 and in Heile et al., U.S. Pat. Nos. 4,595,520 and 4,680,134. Gansser, U.S. Pat. No. 4,753,441, presents a solid detergent technology in a cast solid form using a nitrilotriacetate sequestrant. The solid block detergents quickly replaced a large proportion of conventional powder and liquid forms of warewashing detergents and other products in commercial, institutional and industrial laundry, warewashing, laundry washing and cleaning markets for safety, convenience, and other reasons. The development of these solid block cleaning compositions revolutionized the manner in which many cleaning and sanitizing compositions including warewashing detergent compositions are manufactured and used in commercial, institutional and industrial cleaning locations. Solid block compositions offer certain advantages over conventional liquids, powders, granules, pastes, pellets and other forms of detergents. Such advantages include safety, improved economy, and improved handling.

In the manufacture of powdered detergents, powdered ingredients are typically dry blended or agglomerated in known manufacturing facilities to produce a physically and segregation stable powder composition that can be packaged, distributed and sold without substantial changes in product uniformity. Liquid materials are commonly blended in aqueous or nonaqueous solvent materials, diluted with a proportion of water to produce an aqueous based liquid concentrate which is then packaged, distributed and sold. Solid block detergent compositions are commonly manufactured and formed into a solid often using a hardening mechanism.

In the manufacture of solid detergents, various hardening mechanisms have been used in the manufacture of cleaning and sanitizing compositions for the manufacture of the solid block. Active ingredients have been combined with a hardening agent under conditions that convert the hardening agent from a liquid to a solid rendering the solid material into a mechanically stable block format. One type of such hardening systems is a molten process disclosed in the Fernholz patents. In the Fernholz patents, a sodium hydroxide hydrate, having a melting point of about 55°–60° C., acts as a hardening agent. In the manufacturing process, a molten sodium hydroxide hydrate liquid melt is formed into which is introduced solid particulate materials. A suspension or solution of the solid particulate materials in the molten caustic is formed and is introduced into plastic bottles called capsules, also called container shaped molds, for solidification. The material cools, solidifies and is ready for use. The suspended or solubilized materials are evenly dispersed throughout the solid and are dispensed with the caustic cleaner.

Similarly, in Heile et al., an anhydrous carbonate or an anhydrous sulfate salt is hydrated in the process forming a hydrate, having a melting point of about 55° C., that comprises proportions of monohydrate, heptahydrate and decahydrate solid. The carbonate hydrate is used similarly to the caustic hydrate of Fernholz et al to make a solid block multicomponent detergent. Other examples of such molten processes include Morganson, U.S. Pat. No. 4,861,518 which discloses a solid cleaning concentrate formed by heating an ionic and nonionic surfactant system with the hardening agent such as polyethylene glycol, at temperatures that range greater than about 38° C. to form a melt. Such a melt is combined with other ingredients to form a homogeneous dispersion which is then poured into a mold to harden. Morganson et al, U.S. Pat. No. 5,080,819 teaches a highly alkaline cast solid composition adapted for use at low temperature warewashing temperatures using effective cleaning amounts of a nonionic surfactant to enhance soil removal. Gladfelter, U.S. Pat. No. 5,316,688 teaches a solid block alkaline detergent composition wrapped in a water soluble or water dispersible film packaging.

Solid pelletized materials are shown in Gladfelter, U.S. Pat. Nos. 5,078,301, 5,198,198 and 5,234,615 and in Gansser U.S. Pat. Nos. 4,823,441 and 4,931,202. Such pelletized materials are typically made by extruding a molten liquid or by compressing a powder into a tablet or pellet. Extruded nonimolten alkaline detergent materials are disclosed in Gladfelter et al., U.S. Pat. No. 5,316,688.

These powdered, pellet, liquid and solid block detergent compositions have acceptable cleaning properties for most commercial purposes. Materials introduced into customer based testing or sold in the market place have achieved commercially acceptable and uniformly passing cleaning results. However, we have found, under certain conditions of fabric, ware, substrate, water hardness, machine type, soil type and load, etc., some stains have resisted removal during the cleaning process. We have found that certain starchy soils appear to harden on the surface of ware and resist even highly alkaline cleaning detergents under certain conditions. Such soils are common in the cleaning environment we have found that rice tends to create a starchy soil which can be used as a model for this broad starchy soil genus. Under certain circumstances, such starchy soils can remain on flatware, dishware, etc.

Caustic detergent compositions are described by European publication number 0 282 214 to Blecher, et al. for periodic use in machine dishwashing processes for removal of built-up starch residues. The Blecher et al. publication describes a composition including 20–30 wt. % potassium hydroxide, and spraying the composition onto dishware.

In addition, a number of waxy-fatty soils appear to harden on the surface of ware and resist highly alkaline cleaning detergents under certain conditions. Such soils are common in the cleaning environment and are typically hydrophobic materials that can form thin films on the surface of a variety of items. We have found that lipstick soils can act as a soil model for this broad hydrophobic waxy-fatty soil genus. Lipsticks typically contain a large proportion of lipid, fatty and wax-like materials in a relatively complex mixture including waxy compositions, fatty materials, inorganic components, pigments, etc. The wax-like materials typically include waxes such as candelilla wax, paraffin wax, carnuba wax, etc. Fatty ingredients typically include lanolin derivatives, isopropyl isostearate, octyl hydroxy stearate, castor oil, cetyl alcohol, cetyl lactate, and other materials. Such lipid materials are typically difficult to remove under the best of circumstances. More importantly, we believe the castor oil component of lipstick formulations are unsaturated materials that can act like drying oils and can oxidatively crosslink in thin films to form crosslinked or pseudocrosslinked soil layers that are highly resistant to detergents. The formation of lipstick soils and other similar thin film, fatty or waxy, soils resistant to removal has been a stubborn soil requiring attention for many years. Under certain circumstances such waxy-fatty soils can remain on glassware, cups, flatware, dishware, etc.

A substantial need exists to improve the cleaning properties of solid block detergent materials and particularly as it relates to starchy soils such as those resulting from starchy food products including, for example, rice, noodles, potatoes, soup, flour, etc. In addition, a substantial need exists to provide a detergent which removes, in addition to starchy soils, hydrophobic waxy-fatty soils.

A number of avenues can and have been explored in such an improvement attempt. Examples of research areas can include experimentation in the effects of water temperature, sequestrants that reduce water hardness, the effect of various alkaline sources, the effects of sequestrant types and blends, solvents effects and surfactant choice. The surfactants that can be used in the cast solid materials are vast. There are large numbers of anionic, nonionic, cationic, amphoteric or zwitterionic, etc. surfactants that can be used singly or in combinations of similar or diverse types.

U.K. patent application number GB 2 200 365 to Vesterager describes detergent compositions containing various silicone compounds as replacements for fluorosurfactants. The Vesterager publication is primarily directed at laundry detergent compositions but includes dishwashing detergent compositions for industrial use. The disclosed dishwashing detergent compositions, however, include silicone compounds which are not considered surfactants. U.S. patent application Ser. No. 08/782,336, filed on Jan. 13, 1997 describe warewashing compositions including a surfactant blend of nonionic ethoxylate surfactant and silicone surfactant. The patent application reports that the warewashing detergent composition achieves improved removal of waxy-fatty soils from glassware, cups, flatware, dishware, etc. It should be understood that the entire disclosure of U.S. application Ser. No. 08/782,336 is incorporated herein by reference in its entirety.

Warewashing rinse aid compositions incorporating alkyl polyglycoside (APG) are disclosed. See U.S. Pat. No. 5,501,815 to Man and European publication number 0 432 836. In general, rinse aids are used during the rinse step after the main wash step in a warewashing cycle. U.S. Pat. No. 5,786,320 to Urfer, et al. describes a solid cast detergent product containing a sugar surfactant selected from alkyl polyglycoside, glucamide, and mixtures thereof and salt-form builder to control the viscosity and hardening time of an aqueous detergent slurry.

BRIEF DESCRIPTION OF THE INVENTION

An alkaline detergent composition is provided according to the invention. The alkaline detergent composition includes an effective soil removing amount of a source of alkalinity, and an effective soil removing amount of a surfactant blend. The surfactant blend includes an alkyl polyglycoside surfactant and a silicone surfactant having a hydrophobic silicone group and a pendant hydrophilic group. The surfactant blend is provided so that the detergent composition provides an aqueous use solution having a detergent concentration of between about 500 ppm and about 2000 ppm and a surface tension of less than about 35 dynes/cm. The detergent composition is preferably provided as a machine warewashing detergent composition.

A method for removing soil from an article is provided by the present invention. The typical soils which can be removed by the invention include starchy soils, waxy-fatty soils, protein soils, and combinations thereof. The method includes a step of contacting an article containing soil with an aqueous detergent composition. The aqueous detergent composition can be referred to as a use solution and includes an effective soil removing amount of a source of alkalinity and an effective soil removing amount of a surfactant blend. The surfactant blend includes an alkyl polyglycoside surfactant and a silicone surfactant. The silicone surfactant includes a hydrophobic silicone group and a pendant hydrophilic group. The surfactant blend preferably includes a nonionic surfactant having a hydrophobic group and an $(EO)_x$ group, wherein x is a number of about 1 to about 100. The articles which are preferably contacted with the use composition are preferably ware articles including glasses, plates, cups, eating utensils, serving dishes, etc. The method is particularly suited for removing soil from ware by machine warewashing.

DETAILED DESCRIPTION OF THE PREFERRED EMBODIMENTS

Figure 1:
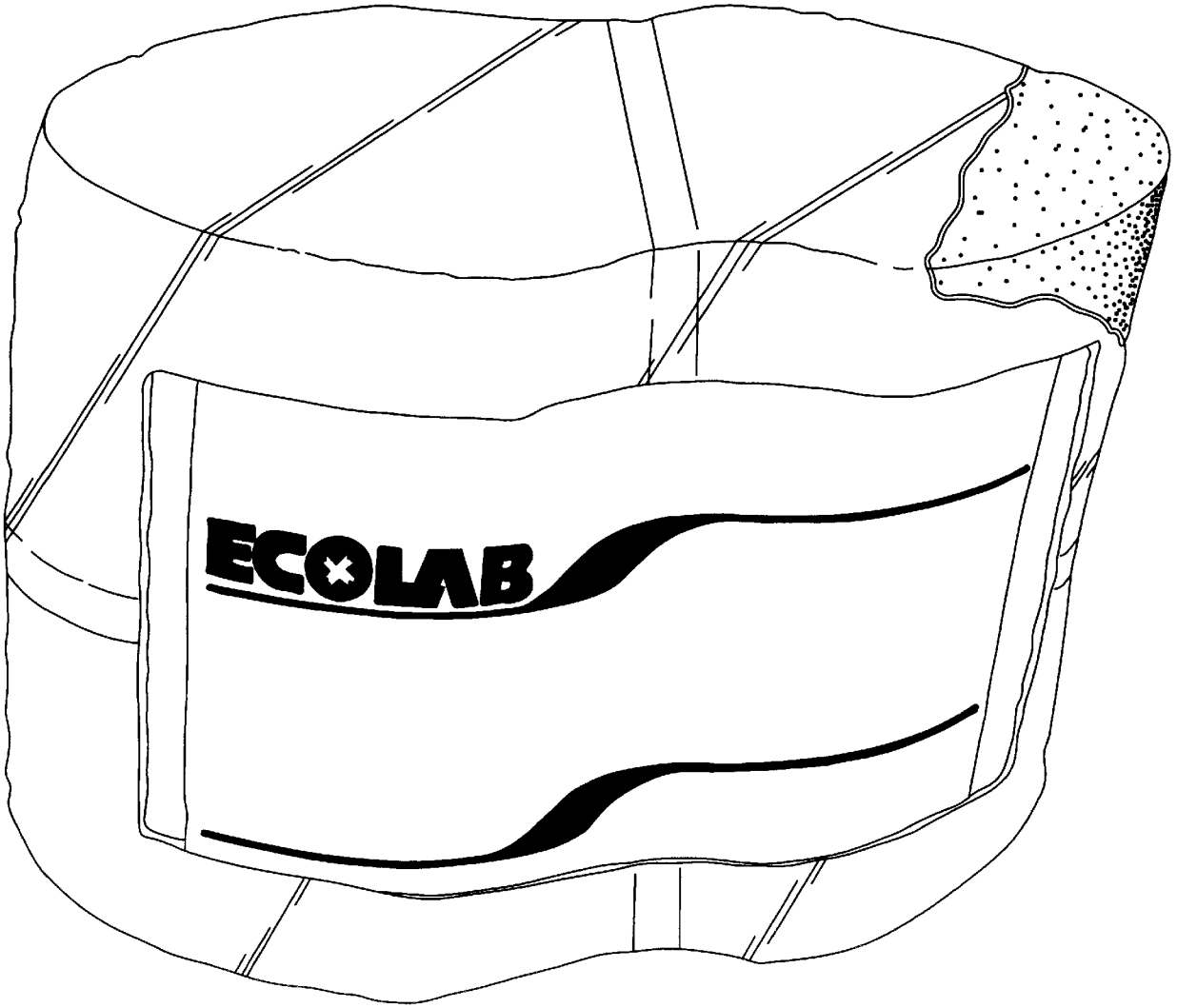
FIG. 1 is a drawing of a current embodiment of the solid block detergent of the invention. The solid block having a mass of about 3.0 kilograms is made in an extrusion process in which individual or selected mixed components are introduced serially through material introduction ports into an extruder, the extruded block is formed with a useful profile at the extruder exit die and is divided into useful 3.0 kg blocks after extrusion. Once hardened, the material can be packaged (e.g.) in a shrink wrap that can be removed before use or dissolved during use.

The detergent composition of the invention combines a source of alkalinity, and a blend of surfactants for providing starchy soil removing capacity. The blend of surfactants preferably includes a first surfactant such as alkyl polyglycoside surfactant, and a second surfactant such as a silicone surfactant having a hydrophobic silicone group and a pendant hydrophilic group. Preferably, the surfactant blend includes a third surfactant including a hydrophobic group and an ethylene oxide residue containing group for assisting in the removal of waxy-fatty soils and/or for reducing foaming, and a polymer additive for assisting in the removal of starch soil.

The detergent composition of the invention can include additional components including a solidifying agent, sequestrants, sanitizing and disinfectant agents, additional surfactants and any variety of other formulatory and application adjuvants. The term detergent composition should be interpreted broadly to include any cleaning, soil conditioning, antimicrobial, soil preparatory, etc. chemical or other liquid, powder, solid, etc. composition which has an alkaline pH and the surfactant blend of the invention in the different physical formats discussed above.

The detergent composition can be used for warewashing, laundry, CIP, hard surface, etc. Applications. A preferred embodiment of the detergent composition of the invention is as a warewashing composition for industrial or machine warewashing applications. Although alkyl polyglycoside has been used in rinse aid compositions, it is not believed it has been successfully used in machine warewashing detergent compositions because of its tendency to cause foaming.

First Surfactant

The first surfactant useful in the present invention is preferably a surfactant which is effective for enhancing the starchy soil removal capability of the detergent composition, under alkaline conditions, resulting from starchy food products including, for example, rice, noodles, potatoes, soup, flour, etc.

A preferred first nonionic surfactant includes alkyl polyglycoside surfactants. Alkyl polyglycosides (APGs), also called alkyl polyglucosides if the saccharide moiety is glucose, which can be used in the present invention, are naturally derived, nonionic surfactants.

The alkyl polyglycosides, which can be used in the present invention, are fatty ether derivatives of saccharides or polysaccharides which are formed when a carbohydrate is reacted under acidic condition with a fatty alcohol through condensation polymerization. The APGs commonly are derived from corn-based carbohydrates and fatty alcohols from natural oils in animals, coconuts and palm kernels. Such methods of deriving APGs are known in the art, for example, U.S. Pat. No. 5,003,057 (McCurry), and the description therein on the methods of making glycosides and chemical properties are incorporated by reference herein.

The alkyl polyglycoside that can be used in the present invention contains a hydrophilic group derived from carbohydrates and is composed of one or more anhydroglucose. Each of the glucose units can have two ether oxygens and three hydroxyl groups and a terminal hydroxyl group, imparting water solubility to the glycoside. The presence of the alkyl carbons leads to the hydrophobic activity. When carbohydrate molecules react with fatty alcohol molecules, alkyl polyglycoside molecules are formed with single or multiple anhydroglucose units, which are termed monoglycosides and polyglycosides, respectively. The final alkyl polyglycoside product typically has a distribution of varying concentration of glucose units (or degree of polymerization).

The APG used in the invention preferably comprises the saccharide or polysaccharide groups (i.e., mono-, di-, tri-, etc. saccharides) of hexose or pentose, and a fatty aliphatic group with 6 to 20 carbon atoms. Alkyl polyglycosides which can be used in the present invention are represented by the general formula of $$(G)_x—O—R \qquad \text{I}$$

where G is a moiety derived from a reducing saccharide containing 5 or 6 carbon atoms, e.g., pentose or hexose; R is fatty aliphatic group containing 6 to 20 carbon atoms; and x is the degree of polymerization (D.P.) of the polyglycoside, representing the number of monosaccharide repeating units in the polyglycoside. Generally, x is an integer on the basis of individual molecules, but because there are statistical variations in the manufacturing process of the APG, x may be a noninteger on an average basis when referred to APG used as an ingredient for the present invention. In this invention, x preferably has a value of less than about 5, and more preferably between about 0.5 and about 5. Even more preferably, x is less than about 2.5, and more preferably is within the range between about 1 and about 2.

Exemplary saccharides from which G is derived are glucose, fructose, mannose, galactose, talose, gulose, allose, altrose, idose, arabinose, xylose, lyxose and ribose. Because of the ready availability of glucose, glucose is preferred in the making of polyglycosides. The fatty aliphatic group, which is the substituent of the preferred polyglycoside, is preferably saturated, although unsaturated fatty group may be used.

Generally, commercially available polyglycosides have alkyl chains of $C_8$ to $C_{16}$ and average degree of polymerization of 1.4 to 1.6. In this invention, specific alkyl polyglycosides will be described as illustrated in the following way: "$C_{12-16}$G 1.4" denotes a polyglycoside with an alkyl chain of 12 to 16 carbon atoms and an average degree of polymerization of 1.4 anhydroglucose units in the alkyl polyglucoside molecule. Commercially, alkyl polyglycosides can be provided as concentrated, aqueous solutions ranging from 50 to 70 wt. % active. Examples of commercial suppliers of alkyl polyglycosides are Henkel Corp. and Union Carbide Corp.

Table 1 shows examples of commercially available (from Henkel Corp.) alkyl polyglycosides that can be used in the present invention. The number of carbons in the alkyl groups and the average degree of polymerization in the APGs are also shown in Table 1. The average degree of polymerization of saccharides in the APG listed varies from 1.4 to 1.7 and the chain lengths of the aliphatic groups are between $C_{8-10}$ and $C_{12-16}$.

Alkyl polyglycosides used in the present invention exhibit low oral and dermal toxicity and irritation on the mammalian tissues, which make them particularly suitable for use on food-contacting ware. These alkyl polyglycosides are also biodegradable in both anaerobic and aerobic conditions and they exhibit low toxicity to plants, thus improving the environmental compatibility of the rinse aid of the present invention. Because of the carbohydrate property and the excellent water solubility characteristics, alkyl polyglycosides are compatible in high caustic and builder formulations.

TABLE 1

Example of alkyl polyglycosides (Henkel Corp.)

| Alkyl Polyglycoside | Henkel Surfactant | Ratio of APGs with Various Chain Lengths |
|---|---|---|
| $C_{8-10}$ G 1.7 | APG 225 | $C_8$:$C_{10}$ (45:55) |
| $C_{9-11}$ G 1.4 | APG 300 | $C_9$:$C_{10}$:$C_{11}$ (20:40:40) |
| $C_{9-11}$ G 1.6 | APG 325 | $C_9$:$C_{10}$:$C_{11}$ (20:40:40) |
| $C_{12-16}$ G 1.4 | APG 600 | $C_{12}$:$C_{14}$:$C_{16}$ (68:26:6) |
| $C_{12-16}$ G 1.6 | APG 625 | $C_{12}$:$C_{14}$:$C_{16}$ (68:26:6) |

In Table 1, the "Ratio of APGs with Various Chain Lengths" is the ratio by weight of the amount of APG of two different alkyl chain lengths in the commercially available APG sample. For example, $C_8$:$C_{10}$ (45:55) means about 45% of the APGs in the sample have alkyl chain length of 8 carbon atom and about 55% of the APGs in the sample have alkyl chain length of 10 carbon atoms. The APGs listed in Table 1 have moderate sheeting characteristics and are chemically compatible with thermoplastics such as polycarbonate and polysulfone.

The applicants have found that these alkyl polyglycoside surfactants provide desired surface activity and lower foaming. Alkyl polyglycoside surfactant which can be used in the present invention are available under the Glucopon® trademark. A preferred alkyl polyglycoside surfactant is Glucopon® 600 which is characterized by a degree of polymerization of 1.4 and an alkyl group containing 12–16 carbon atoms.

While alkyl polyglycoside surfactants are a preferred nonionic surfactant, other surfactants which can be used include derivatives of alkyl polyglycoside surfactants, surfactants containing a sugar ring, and alkyl polyglucosimide. In addition, blends of alkyl polyglycoside surfactants can be used as well as blends of alkyl polyglycoside surfactants and derivatives of alkyl polyglycoside surfactants.

The first nonionic surfactant may be solid or liquid, and is preferably used in the detergent composition of the present invention an amount sufficient to provide the desired level of starchy soil removal. In general, this corresponds to an amount of from about 0.1 wt. % to about 30 wt. %, preferably from about 0.2 wt. % to about 10 wt. %, and most preferably from about 0.3 wt. % to about 4 wt. %. It should be appreciated that these percentages by weight are provided on a dry basis. That is, the identified amount of first nonionic surfactant is provided based upon the total weight of all components in the detergent composition excluding water. Furthermore, the amount of first nonionic surfactant varies within the identified ranges, depending on the incorporation of additional components in the detergent. In the situation where the detergent composition does not include a surfactant which reduces foaming, the amount of first nonionic surfactant is preferably within a range of about 0.1 wt. % and about 2 wt. %.

Second Surfactant

The second surfactant which can be used in the detergent composition according to the invention is preferably a silicone surfactant which provides an aqueous use solution having a reduced surface tension compared to aqueous use solutions not containing the silicone surfactant. The silicone surfactant preferably includes a polysiloxane hydrophobic group modified with one or more pendent hydrophilic polyalkylene oxide groups. Such silicone surfactants provide a detergent use composition having low surface tension, high wetting, antifoaming and excellent stain removal. The silicone surfactant can be advantageously used in a detergent composition with the first surfactant for reducing the surface tension of the aqueous solutions, or use solution, to less than about 35 dynes/cm, and preferably between about 35 and about 15 dynes/cm, and more preferably between about 30 and about 15 dynes/cm. The silicone surfactant can be considered nonionic or ionic (i.e., amphoteric).

Preferred silicone surfactants which can be used according to the invention can be characterized as polydialkyl siloxanes, preferably polydimethyl siloxanes to which hydrophilic group(s), such as polyethylene oxide, have been grafted through a hydrosilation reaction. The process results in an alkyl pendent (AP type) copolymer, in which the hydrophilic groups are attached along the siloxane backbone through a series of hydrolytically stable Si—C bond. The modified polydialkyl siloxane surfactants can have the following generic formulae:

II

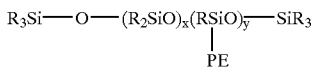

III

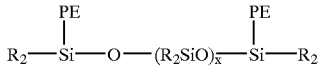

wherein PE represents a nonionic group, preferably $—CH_2—(CH_2)_p—O—(EO)_m(PO)_n—Z$, EO representing ethylene oxide, PO representing propylene oxide, x is a number that ranges from about 0 to about 100, y is a number that ranges from about 1 to 100, m, n and p are numbers that range from about 0 to about 50, m+n≧1 and Z represents hydrogen or R wherein each R independently represents a lower ($C_{1-6}$) straight or branched alkyl. Preferably, p is a number from 0 to 6, and R is methyl.

Preferred silicone surfactants have the formula:

IV

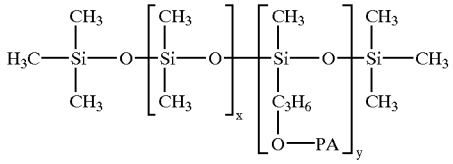

PA = 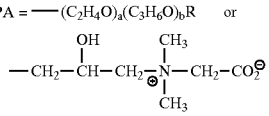 or wherein x represent a number that ranges from about 0 to about 100, y represent a number that ranges from about 1 to about 100, a and b represent numbers that independently range from about 0 to about 60, a+b≧1, and each R is independently H or a lower straight or branched ($C_{1-6}$) alkyl. A preferred silicone surfactant having formula IV includes x+y of about 24 to about 30, y of about 4 to about 7, the ratio of a/b being about 0.25, R being H, PA having a molecular weight of between about 800 and about 950, and the silicone surfactant having a molecular weight of between about 5,500 and about 6,500. A preferred silicone surfactant satisfying this criteria is available under the name ABIL® B 8852. A preferred silicone betaine surfactant is provided where x+y is about 16 to about 21, y is about 4 to about 7, and the molecular weight of the silicone betaine surfactant is between about 2,000 and 3,000. A silicone surfactant generally satisfying this criteria is available under the name ABIL® B 9950.

Preferred silicone surfactants are sold under the SILWET® trademark or under the ABIL® B trademark. One preferred silicone surfactant, SILWET® L77, has the formula:

$$(CH_3)_3Si—O(CH_3)Si(R^1)O—Si(CH_3)_3 \quad \text{V}$$

wherein $R^1$ is $—CH_2CH_2CH_2—O—(CH_2CH_2O)_zCH_3$ and wherein z is 4 to 16 preferably 4 to 12, most preferably 7–9.

Another class of silicone surfactants is an end-blocked (AEB type). Preferred AEB type silicone surfactants have the following general formula:

VI

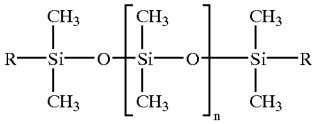

$$R = —(CH_2)_3—O—(C_2H_4O)_x(C_3H_6O)_y—H$$

$$R = —(CH_2)_3—O—(C_2H_4O)_x(C_3H_6O)_y—H$$

wherein x represents 0 to 100, y represents 1 to 100, x+y represent 1 to 200. A preferred AEB type silicone surfactant is available under the name ABIL® EM 97.

The second surfactant can be provided in the detergent composition of the invention in an amount of from about 0.05 wt. % to about 20 wt. %. Preferably, the second surfactant is provided in an amount of between about 0.1 wt. % and about 10 wt. %, and more preferably in an amount of between about 0.3 wt. % and about 1 wt. %.

Third Surfactant

The third surfactant is an optional component of the detergent composition of the invention. When used, the third surfactant can provide the detergent composition with defoaming properties and/or waxy-fatty soil removal properties. Preferred third surfactants which can be used include compounds produced by the condensation of an ethylene oxide (forming groups that are hydrophilic in nature) with an organic hydrophobic compound which can be aliphatic, alkyl or alkyl aromatic (hydrophobic) in nature. The length of the hydrophilic polyoxyethylene moiety which can be condensed with another particular hydrophobic compound can be readily adjusted, in size or combined with (PO) propylene oxide, other alkylene oxides or other substituents such as benzyl caps to yield a water-soluble compound having the desired degree of balance between hydrophilic and hydrophobic elements. The third surfactant is preferably a nonionic surfactant.

The condensation products of aliphatic alcohols with ethylene oxide can also exhibit useful surfactant properties. The alkyl chain of the aliphatic alcohol may either be straight or branched and generally contains from about 3 to about 22 carbon atoms. Preferably, there are from about 3 to about 18 moles of ethylene oxide per mole of alcohol. The polyether can be conventionally end capped with acyl groups including methyl, propyl, benzyl, etc. groups. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation. PLURAFAC® RA-40 marketed by BASF Corp. Neodol 23-6.5 marketed by the Shell Chemical Company and Kyro EOB marketed by the Procter & Gamble Company.

The condensation products of ethylene oxide with a hydrophobic base formed by the condensation of propylene oxide with propylene glycol can be used. The hydrophobic portion of these compounds has a molecular weight of from about 1,500 to 1,800 and of course exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product. Examples of compounds of this type include certain of the commercially available Pluronic surfactants marketed by BASF Corporation.

The condensation products of ethylene oxide with the product resulting from the reaction of propylene oxide and ethylene diamine can be used. The hydrophobic base of these products consists of the reaction product of ethylene diamine and excess propylene oxide, said base having a molecular weight of from about 2,500 to about 3,000. This base is condensed with ethylene oxide to the extent that the condensation product contains from about 40 to about 80 percent by weight of polyoxyethylene and has a molecular weight of from about 5,000 to about 11,000. Examples of this type of nonionic surfactant include certain of the commercially available Tetronic compounds marketed by the BASF Corporation. Mixtures of the above surfactants are also useful in the present invention.

Preferred nonionic surfactants used herein are the ethoxylated nonionics, both from the standpoint of availability and cleaning performance. Specific examples of alkoxylated nonionic surfactants include, but are not limited to a benzyl ether of a $C_{6-24}$ linear alcohol 5–15 mole ethoxylate, PLURAFAC® RA-40, a straight chain alcohol ethoxylate, Triton CF-21 an alkyl aryl polyether, Triton CF-54, a modified polyethoxy adduct, and others. Applicants have found that the third nonionic surfactant component is particularly useful for removing waxy-fatty soils, and for reducing foaming normally associated with the use of alkyl polyglycoside surfactants.

A particularly preferred third nonionic surfactant includes an alkyl-ethoxylate-propoxylate surfactant such as alkyl-$(EO)_3$—$(PO)_6$ which is available under the name Dehypon® LS-36 from Henkel KGaA.

The third nonionic surfactant may be solid or liquid and can be used in the detergent composition in an amount from about 0 wt. % to about 6 wt. %. Preferably, the third nonionic surfactant is used in an amount of between about 0.1 wt. % and about 6 wt. %, more preferably between about 0.5 wt. % and about 4 wt. %, and even more preferably between about 1 wt. % and about 3 wt. %.

Polymer Additive

A polymer additive is an optional component of the detergent composition and can be provided for assisting in the removal of starch soil. The polymer additive can sometimes be referred to as a polymeric dispersing agent. Preferred polymer additives can be characterized as polycarboxylates. Preferred polycarboxylate polymers include acrylic acid homopolymer, maleic/olefin copolymer, acrylic/maleic copolymer sulfonic acid homopolymer, acrylamido-2-methylpropane/sulfonic acid copolymer, and phosphino carboxylic acid polymer. Polymers which can be used as polymer additives are available under the name ACUSOL® from Rohm & Haas. Preferred polymer additives are available as ACUSOL® 445N, ACUSOL® 460 ND, ACUSOL® 479N, ACUSOL® 410, and ACUSOL® 441. Additional polymer additives which can be used are available under the name ACUMER® and, in particular, ACUMER® 2000 and ACUMER® 2100.

The polymer additive is an optional component in the detergent composition of the invention and can be provided in an amount of up to about 6 wt. %. Preferably, the polymer additive is present in an amount of between about 0.1 wt. % and about 5 wt. %, and more preferably in an amount of between about 0.5 wt. % and about 2 wt. %.

Deterrent Composition

The surfactants can be combined in the following amounts on a dry basis. It should be appreciated that the ranges are determined based upon the function of the surfactant and the cost. That is, there should be enough of a particular surfactant present to provide the detergent composition with the desired level of soil removal properties. Because surfactants are expensive, it is generally desirable not to include an excessive amount of a particular surfactant since that would tend to drive up the cost of the detergent composition. The alkyl polyglycoside surfactant is preferably provided in an amount of between about 0.2 wt. % and about 10 wt. %, and more preferably between about 0.3 wt. % and about 4 wt. %. The silicone surfactant is preferably provided in an amount of between about 0.1 wt. % and about 10 wt. %, and more preferably in an amount of between about 0.3 wt. % and about 1 wt. %. The nonionic ethylene oxide surfactant component is preferably provided in an amount up to about 6 wt. %, and more preferably between about 0.5 wt. % and about 5 wt. %. The polymer additive is preferably provided in an amount up to about 6 wt. %, and more preferably in an amount of between about 0.1 wt. % and about 5 wt. %. The total amount of alkyl polyglycoside surfactant and silicone surfactant is between about 0.2 wt. % and about 20 wt. %, and more preferably between about 0.3 wt. % and about 5 wt. %.

It should be appreciated that the amount of the various surfactants can be adjusted to provide the desired level of soil removal for a particular type of soil commonly encountered. For example, the surfactants can be adjusted to reflect the desired degree of starchy soil removal, fatty-waxy soil removal, or protein soil removal. A preferred detergent composition contains about 1.0 parts by weight alkyl polyglycoside, about 0.5 parts silicone surfactant, and about 1.0 parts by weight polymer additive.

The alkyl polyglycoside and the silicone surfactant are preferably provided at a weight ratio of between about 1:1 to about 20:1, and more preferably between about 1.5:1 and about 7:1. A particularly preferred ratio of alkyl polyglycoside to silicone surfactant is about 2:1.

When the detergent composition is used for warewashing, the surfactant blend is preferably provided at a concentration of between about 10 ppm and about 500 ppm to provide a desired use concentration. The detergent composition is typically used in industrial ware washing machines at a detergent temperature of about 120° F. to about 170° F. The use composition for warewashing preferably includes a detergent composition of between about 500 ppm and about 2,000 ppm. A use solution for laundry applications is generally greater than about 500 ppm. In most laundry applications, the detergent composition will be provided at a concentration of below about 5,000 ppm, and preferably from about 500 ppm to about 5,000 ppm.

Source of Alkalinity

To provide an alkaline pH, the composition comprises an alkalinity source. Generally, the alkalinity source raises the pH of the composition to at least 10.0 in a 1 wt-% aqueous solutions and preferably to a range of from about 10.5 to 14. Such pH is sufficient for soil removal and sediment breakdown when the chemical is placed in use and further facilitates the rapid dispersion of soils. The general character of the alkalinity source is limited only to those chemical compositions which have a substantial aqueous solubility. Exemplary alkalinity sources include an alkali metal silicate, hydroxide, phosphate, or carbonate.

The alkalinity source can include an alkali metal hydroxide including sodium hydroxide, potassium hydroxide, lithium hydroxide, etc. Mixtures of these hydroxide species can also be used. Alkaline metal silicates can also act as a source of alkalinity for the detergents of the invention. Useful alkaline metal silicates correspond with the general formula ($M_2O:SiO_2$) wherein for each mole of $M_2O$ there is less than one mole of $SiO_2$. Preferably for each mole of $SiO_2$ there is from about 0.2 to about 100 moles of $M_2O$ wherein M comprises sodium or potassium. Preferred sources of alkalinity are alkaline metal orthosilicate, alkaline metal metasilicate, and other well known detergent silicate materials.

The alkalinity source can include an alkali metal carbonate. Alkali metal carbonates which may be used in the invention include sodium carbonate, potassium carbonate, sodium or potassium bicarbonate or sesquicarbonate, among others. Preferred carbonates include sodium and potassium carbonates. These sources of alkalinity can be used the detergents of the invention at concentrations about 5 wt-% to 70 wt-%, preferably from about 15 wt-% to 65 wt-%, and most preferably from about 30 wt-% to 55 wt-%.

Other Additives

In order to soften or treat water, prevent the formation of precipitates or other salts, the composition of the present invention generally comprises components known as chelating agents, builders or sequestrants. Generally, sequestrants are those molecules capable of complexing or coordinating the metal ions commonly found in service water and thereby preventing the metal ions from interfering with the functioning of detersive components within the composition. The number of covalent bonds capable of being formed by a sequestrant upon a single hardness ion is reflected by labeling the sequestrant as bidentate (2), tridentate (3), tetradendate (4), etc. Any number of sequestrants may be used in accordance with the invention. Representative sequestrants include salts of amino carboxylic acids, phosphonic acid salts, water soluble acrylic polymers, among others.

Suitable amino carboxylic acid chelating agents include N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA). When used, these amino carboxylic acids are generally present in concentrations ranging from about 1 wt-% to 50 wt-%, preferably from about 2 wt-% to 45 wt-%, and most preferably from about 3 wt-% to 40 wt-%.

Other suitable sequestrants include water soluble acrylic polymers used to condition the wash solutions under end use conditions. Such polymers include polyacrylic acid, polymethacrylic acid, acrylic acid-methacrylic acid copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers such as their respective alkali metal (for example, sodium or potassium) or ammonium salts can also be used. The weight average molecular weight of the polymers is from about 4000 to about 12,000. Preferred polymers include polyacrylic acid, the partial sodium salts of polyacrylic acid or sodium polyacrylate having an average molecular weight within the range of 4000 to 8000. These acrylic polymers are generally useful in concentrations ranging from about 0.5 wt-% to 20 wt-%, preferably from about 1 to 10, and most preferably from about 1 to 5.

Also useful as sequestrants are alkali metal phosphates, condensed and cyclic phosphates, phosphonic acids and phosphonic acid salts. Useful phosphates include alkali metal pyrophosphate, an alkali metal polyphosphate such a sodium tripolyphosphate (STPP) available in a variety of particle sizes. Such useful phosphonic acids include, mono, di, tri and tetra-phosphonic acids which can also contain groups capable of forming anions under alkaline conditions such as carboxy, hydroxy, thio and the like. Among these are phosphonic acids having the generic formula motif $R_1N[CH_2PO_3H_2]_2$ or $R_2C(PO_3H_2)_2OH$, wherein $R_1$ may be -[(lower $C_{1-6}$)alkylene]-N—$[CH_2PO_3H_2]_2$ or a third —$(CH_2PO_3H_2)$ moiety; and wherein $R_2$ is selected from the group consisting of a lower ($C_1$–$C_6$) alkyl. The phosphonic acid may also comprise a low molecular weight phosphonopolycarboxylic acid such as one having about 2–4 carboxylic acid moieties and about 1–3 phosphonic acid groups. Such acids include 1-hydroxyethane-1,1-diphosphonic acid $CH_3C(OH)[PO(OH)_2]_2$; aminotri (methylenephosphonic acid) $N[CH_2PO(OH)_2]_3$; aminotri (methylenephosphonate), sodium salt

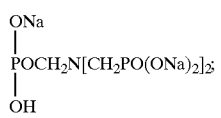

2-hydroxyethyliminobis(methylenephosphonic acid) $HOCH_2CH_2N[CH_2PO(OH)_2]_2$; diethylenetriaminepenta (methylenephosphonic acid) $(HO)_2POCH_2N[CH_2CH_2N[CH_2PO(OH)_2]_2]_2$; diethylenetriaminepenta (methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis (hexamethylene)triamine(pentainethylenephosphonic acid) $(HO_2)POCH_2N[(CH_2)_6N[CH_2PO(OH)_2]_2]_2$; and phosphorus acid $H_3PO_3$. The preferred phosphonate is aminotrimethylenephosphonic acid or salts thereof combined optionally with diethylenetriaminepenta(methylenephosphonic acid). When used as a sequestrant in the invention, phosphonic acids or salts are present in a concentration ranging from about 0.25 to 25 wt %, preferably from about 1 to 20 wt %, and most preferably from about 1 to 18 wt % based on the solid detergent.

The invention may also comprise a solidifying agent to create a solid detergent mass from a blend of chemical components. Generally, any agent or combination of agents which provides a requisite degree of solidification and aqueous solubility may be used with the invention. A solidification agent may be selected from any organic or inorganic compound which imparts a solid character and/or controls the soluble character of the present composition when placed in an aqueous environment. The solidifying agent may provide for controlled dispensing by using solidification agents which have a relative increase in aqueous solubility. For systems which require less aqueous solubility or a slower rate of dissolution an organic nonionic or amide hardening agent may be appropriate. For a higher degree of aqueous solubility, an inorganic solidification agent or a more soluble organic agent such as urea.

Compositions which may be used with the present invention to vary hardness and solubility include amides such as stearic monoethanolamide, lauric diethanolamide, and stearic diethanolamide. Nonionic surfactants have also been found to impart varying degrees of hardness and solubility when combined with a coupler such as propylene glycol or polyethylene glycol. Nonionics useful in this invention include nonylphenol ethoxylates, linear alkyl alcohol ethoxylates, ethylene oxide/propylene oxide block copolymers such as the Pluronic surfactants commercially available from BASF Corporation.

Nonionic surfactants particularly desirable as hardeners are those which are solid at room temperature and have an inherently reduced aqueous solubility as a result of the combination with the coupling agent.

Other surfactants which may be used as solidifying agents include anionic surfactants which have high melting points to provide a solid at the temperature of application. Anionic surfactants which have been found most useful include linear alkyl benzene sulfonate surfactants, alcohol sulfates, alcohol ether sulfates, and alpha olefin sulfonates. Generally, linear alkyl benzene sulfonates are preferred for reasons of cost and efficiency.

Amphoteric or zwitterionic surfactants are also useful in providing detergency, emulsification, wetting and conditioning properties. Representative amphoteric surfactants include N-coco-3-aminopropionic acid and acid salts, N-tallow-3-iminodiproprionate salts. As well as N-lauryl-3-iminodiproprionate disodium salt, N-carboxymethyl-N-cocoalkyl-N-dimethylammonium hydroxide, N-carboxymethyl-N-dimethyl-N-(9-octadecenyl) ammonium hydroxide, (1-carboxyheptadecyl) trimethylammonium hydroxide, (1-carboxyundecyl) trimethylammonium hydroxide, N-cocoamidoethyl-N-hydroxyethylglycine sodium salt, N-hydroxyethyl-N-stearamidoglycine sodium salt, N-hydroxyethyl-N-lauramido-b-alanine sodium salt, N-cocoamido-N-hydroxyethyl-b-alanine sodium salt, as well as mixed alicyclic amines, and their ethoxylated and sulfated sodium salts, 2-alkyl-1-carboxymethyl-1-hydroxyethyl-2-imidazolinium hydroxide sodium salt or free acid wherein the alkyl group may be nonyl, undecyl, or heptadecyl. Also useful are 1,1-bis(carboxymethyl)-2-undecyl-2-imidazolinium hydroxide disodium salt and oleic acid-ethylenediamine condensate, propoxylated and sulfated sodium salt. Amine oxide amphoteric surfactants are also useful. This list is by no means exclusive or limiting.

Other compositions which may be used as hardening agents with the composition of the invention include urea, also known as carbamide, and starches which have been made water soluble through an acid or alkaline treatment. Also useful are various inorganics which either impart solidifying properties to the present composition and can be processed into pressed tablets for carrying the alkaline agent. Such inorganic agents include calcium carbonate, sodium sulfate, sodium bisulfate, alkali metal phosphates, anhydrous sodium acetate and other known hydratable compounds. We have also found a novel hardening or binding agent for alkaline metal carbonate detergent compositions.

We believe the binding agent comprises an amorphous complex of an organic phosphonate compound, sodium carbonate, and water. The proportions of this binding hardening agent is disclosed in copending U.S. Ser. No. 08/781,493 which is incorporated by reference herein in its entirety. This carbonate phosphate water binding agent can be used in conjunction with other hardening agents such as a nonionic, etc.

The solidifying agents can be used in concentrations which promote solubility and the requisite structural integrity for the given application. Generally, the concentration of solidifying agent ranges from about 1 wt-% to 90 wt-%, preferably from about 1.5 wt-% to 85 wt-%, and most preferably from about 2 wt-% to 80 wt-%.

The detergent composition of the invention may also comprise a bleaching source. Bleaches suitable for use in the detergent composition include any of the well known bleaching agents capable of removing stains from such substrates as dishes, flatware, pots and pans, textiles, countertops, appliances, flooring, etc. without significantly damaging the substrate. These compounds are also capable of providing disinfecting and sanitizing antimicrobial efficacy in certain applications. A nonlimiting list of bleaches include hypochlorites, chlorites, chlorinated phosphates, chloroisocyanates, chloroamines, etc.; and peroxide compounds such as hydrogen peroxide, perborates, percarbonates, etc.

Preferred bleaches include those bleaches which liberate an active halogen species such as $Cl_2$, $Br_2$, $OCl^-$, or $OBr^-$ under conditions normally encountered in typical cleaning processes. Most preferably, the bleaching agent releases $Cl_2$ or $OCl^-$. A nonlimiting list of useful chlorine releasing bleaches includes calcium hypochloride, lithium hypochloride, chlorinated trisodiumphosphate, sodium dichloroisocyanaurate, chlorinated trisodium phosphate, sodium dichloroisocyanurate, potassium dichloroisocyanurate, pentaisocyanurate, trichloromelamine, sulfondichloro-amide, 1,3-dichloro 5,5-dimethyl hydantoin, N-chlorosuccinimide, N,N'-dichloroazodicarbonimide, N,N'-chloroacetylurea, N,N'-dichlorobiuret, trichlorocyanuric acid and hydrates thereof. Because of their higher activity and higher bleaching efficacies the most preferred bleaching agents are the alkaline metal salts of dichloroisocyanurates and the hydrates thereof. Generally, when present, the actual concentration of bleach source or agent (in wt-% active) may comprise about 0.5 to 20 wt-%, preferably about 1 to 10 wt-%, and most preferably from about 2 to 8 wt-% of the solid detergent composition.

The composition of the invention may also comprise a defoaming surfactant useful in warewashing compositions. A defoamer is a chemical compound with a hydrophobe-hydrophile balance suitable for reducing the stability of protein foam. The hydrophobicity can be provided by an oleophilic portion of the molecule. For example, an aromatic alkyl or alkyl group, an oxypropylene unit or oxypropylene chain, or other oxyalkylene functional groups other than oxyethylene provide this hydrophobic character. The hydrophilicity can be provided by oxyethylene units, chains, blocks and/or ester groups. For example, organophosphate esters, salt type groups or salt forming groups all provide hydrophilicity within a defoaming agent. Typically, defoamers are nonionic organic surface active polymers having hydrophobic groups, blocks or chains and hydrophilic ester groups, blocks, units or chains. However, anionic, cationic and amphoteric defoamers are also known. Phosphate esters are also suitable for use as defoaming agents. For example, esters of the formula $RO—(PO_3M)_n—R$ wherein n is a number ranging from 1 to about 60, typically less than 10 for cyclic phosphates, M is an alkali metal and R is an organic group or M, with at least one R being an organic group such as an oxyalkylene chain. Suitable defoaming surfactants include ethylene oxide/propylene oxide blocked nonionic surfactants, fluorocarbons and alkylated phosphate esters. When present defoaming agents may be present in a concentration ranging from about 0.1 wt-% to 10 wt-%, preferably from about 0.5 wt-% to 6 wt-% and most preferably from about 1 wt-% to 4 wt-% of the composition.

DETAILED DESCRIPTION OF THE DRAWINGS

FIG. 1 is a drawing of a preferred embodiment of the packaged solid block detergent 10 of the invention. In FIG. 1 the overall solid block product 10 is shown having a cast solid block 11 (revealed by the removal of packaging 12). The packaging includes a label 13 adhered to the packaging 12. The film wrapping can easily be removed using a weakened tear line 15 or fracture line or 15*a* incorporated in the wrapping.

The foregoing description of the invention provides an understanding of the individual components that can be used in formulating the solid block detergents of the invention. The following examples illustrate the preferred embodiments of the invention.

In the manufacture of the detergent, a dry bend powder can be made by blending powdered components into a complete formulation. Liquid ingredients can be pre-adsorbed onto dry components or encapsulated prior to mixing. Agglomerated materials can be made using known techniques and equipment. In manufacture of the solid detergent of the invention, the ingredients are mixed together at high shear to form a substantially homogenous consistency wherein the ingredients are distributed substantially evenly throughout the mass. The mixture is then discharged from the mixing system by casting into a mold or other container, by extruding the mixture, and the like. Preferably, the mixture is cast or extruded into a mold or other packaging system, that can optionally, but preferably, be used as a dispenser for the composition. The temperature of the mixture when discharged from the mixing system is maintained sufficiently low to enable the mixture to be cast or extruded directly into a packaging system without first cooling the mixture. Preferably, the mixture at the point of discharge is at about ambient temperature, about 30–50° C., preferably about 35–45° C. The composition is then allowed to harden to a solid form that may range from a low density, sponge-like, malleable, caulky consistency to a high density, fused solid, concrete-like block.

In a preferred method according to the invention, the mixing system is a twin-screw extruder which houses two adjacent parallel or counter rotating screws designed to co-rotate and intermesh, the extruder having multiple ingredient inlets, barrel sections and a discharge port through which the mixture is extruded. The extruder may include, for example, one or more feed or conveying sections for receiving and moving the ingredients, a compression section, mixing sections with varying temperature, pressure and shear, a die section to shape the detergent solid, and the like. Suitable twin-screw extruders can be obtained commercially and include for example, Buhler Miag Model No. 62 mm, Buhler Miag, Plymouth, Minn. USA.

Extrusion conditions such as screw configuration, screw pitch, screw speed, temperature and pressure of the barrel sections, shear, throughput rate of the mixture, water content, die hole diameter, ingredient feed rate, and the like, may be varied as desired in a barrel section to achieve effective processing of ingredients to form a substantially homogeneous liquid or semi-solid mixture in which the ingredients are distributed evenly throughout. To facilitate processing of the mixture within the extruder, it is preferred that the viscosity of the mixture is maintained at about 1,000–1,000,000 cP, more preferably about 5,000–200,000 cP.

The extruder comprises a high shear screw configuration and screw conditions such as pitch, flight (forward or reverse) and speed effective to achieve high shear processing of the ingredients to a homogenous mixture. Preferably, the screw comprises a series of elements for conveying, mixing, kneading, compressing, discharging, and the like, arranged to mix the ingredients at high shear and convey the mixture through the extruder by the action of the screw within the barrel section. The screw element may be a conveyor-type screw, a paddle design, a metering screw, and the like. A preferred screw speed is about 20–250 rpm, preferably about 40–150 rpm.

Optionally, heating and cooling devices may be mounted adjacent the extruder to apply or remove heat in order to obtain a desired temperature profile in the extruder. For example, an external source of heat may be applied to one or more barrel sections of the extruder, such as the ingredient inlet section, the final outlet section, and the like, to increase fluidity of the mixture during processing through a section or from one section to another, or at the final barrel section through the discharge port. Preferably, the temperature of the mixture during processing including at the discharge port, is maintained at or below the melting temperature of the ingredients, preferably at about 50–200° C.

In the extruder, the action of the rotating screw or screws will mix the ingredients and force the mixture through the sections of the extruder with considerable pressure. Pressure may be increased up to about 6,000 psig, preferably between about 5–150 psig, in one or more barrel sections to maintain the mixture at a desired viscosity level or at the die to facilitate discharge of the mixture from the extruder.

The flow rate of the mixture through the extruder will vary according to the type of machine used. In general, a flow rate is maintained to achieve a residence time of the mixture within the extruder effective to provide substantially complete mixing of the ingredients to a homogenous mixture, and to maintain the mixture at a fluid consistency effective for continuous mixing and eventual extrusion from the mixture without premature hardening.

When processing of the ingredients is complete, the mixture may be discharged from the extruder through the discharge port, preferably a shaping die for the product outside profile. The pressure may also be increased at the discharge port to facilitate extrusion of the mixture, to alter the appearance of the extrudate, for example, to expand it, to make it smoother or grainier in texture as desired, and the like.

The cast or extruded composition eventually hardens due, at least in part, to cooling and/or the chemical reaction of the ingredients. The solidification process may last from one minute to about 2–3 hours, depending, for example, on the size of the cast or extruded composition, the ingredients of the composition, the temperature of the composition, and other like factors. Preferably, the cast or extruded composition "sets up" or begins to harden to a solid form within about 1 minute to about 2 hours, preferably about 5 minutes to about 1 hour, preferably about 1 minute to about 20 minutes.

The above specification provides a basis for understanding the broad meets and bounds of the invention. The following examples and test data provide an understanding of the specific embodiments of the invention and contain a best mode. These examples are not meant to limit the scope of the invention that has been set forth in the foregoing description. Variation within the concepts of the invention are apparent to those skilled in the art.

EXAMPLE 1

Surface Tension Measurement

A 3000 mg/L solution of the desired formulation was created and added to a 50-ml sample of DI water in increments. Surface tension measurements were taken after each addition of detergent. The final concentration for each test (formulation) was set for 1108 mg/L (PPM), within range of a typical use concentration in a warewash environment.

Surface tension measurements were accomplished on the Krüss K12 Surface Tensiometer using the manufacture's described procedure. Surface tension is reported in dynes/cm or mN/m. In general, a solution of the desired formulation was prepared and dosed into the Krüss K12. Upon sequential additional dosing, surface tension information was collected at increasing concentration. From the data generated, a plot of Surface Tension versus concentration is created, giving a surface tension profile of the formulation at specific concentrations. The initial concentrations of each formula and dose increment were held constant, giving a reasonable tool to compare surface tension profiles for varying formulations.

Formulations tested

The base detergent contains ash and sodium tripolyphosphate. The surfactants added to this system give the variable surface tension results and detergency. For consistency, each formulation contained 30% of sodium tripolyphosphate, 5.796% of Briquest 301-50A (50% solution of aminotrimethylene phosphonic acid), 4.561% of 50% sodium hydroxide, variable percentages of surfactant(s) and the balance, ash. For simplicity, the percentage of surfactant (% active) is reported.

| Formulation | B | C | 1 | 2 | 3 |
|---|---|---|---|---|---|
| LF-428 | 2.5 | 2.5 | 0 | 0 | 0 |
| D-500 | 1.3 | 2.9 | 2.9 | 2.9 | 2.5 |
| APG | 0 | 2.0 | 2.0 | 2.0 | 2 |
| LS-36 | 0 | 2.0 | 2.0 | 2.0 | 2 |
| Silicone Surfactant | 0.5 | 0 | 0.5 | 0.5 | 1 |
| Surface Tension (dynes/cm) | 25.63 | 28.10 | 23.60 | 21.28 | 23.46 |

Silicone surfactant used in Formulations B and 1 was Abil B 8852, silicone surfactant used in Formulation 2 was Abil B 88163, and silicone surfactant used in Formulation 3 was Wacker S 370. LF-428 is benzyl capped alcohol ethoxylate available from Ecolab, Inc. D-500 is an ethylene oxide and propylene oxide block copolymer available from Ecolab Inc. APG is alkyl polyglycoside available from Henkel KGaA. Dehypon LS-36 is alky alkoxylate available from Henkel KGAA. Abil 8852 is hydrophilicly modified polydimethyl siloxane available from Goldschmidt. Acusol 460N is modified polycarboxylate available from Rohm & Haas. Formulation B is an ash based detergent composition.

EXAMPLE 2

Two starch removal assays were developed for direct comparison of performance versus formulation change. In general, those formulations with alkyl polyglycoside surfactant and a modified functionalized siloxane surfactant gave a better performance profile. Included in these tests are a one cycle, dried on starch removal assay and a five cycle starch redeposition test One Cycle Test Materials

| | |
|---|---|
| Jasmine rice | 150 grams cooked and pureed with 150 grams of water |
| Chinaware plates | 12 to 15 plates |
| Hobart AM-14 | 60.5 liter reservoir, 4.5 liter rinse |
| Detergent | Approximately 300 grams, dissolved to a 5% wt/wt solution |

Procedure

Soil enough plates with the Jasmine rice mixture by brushing 1.5 grams of soil to the plate. Allow the soil to dry for at least 16 hours. Charge the clean Hobart AM-14 with the appropriate volume of detergent solution. Run the three soiled plates through one full cycle. Allow the plates to dry for at least one hour. Stain the plates with $I_2$ and score plate. Rinse and clean the warewashing machine. This procedure is run at different detergent concentrations in the reservoir, typically at 0, 600, 1000, 1200 and 1500 PPM. A one-cycle test typically requires about 1½ hours of preparation and run time.

Five Cycle Test

| | |
|---|---|
| Jasmine rice | 150 grams cooked and pureed with 150 grams of water |
| Chinaware plates | 8 plates |
| Hobart AM-14 | 60.5 liter reservoir, 4.5 liter rinse |
| Detergent | Approximately 100 grams, dissolved to a 5% wt/wt solution |

Procedure

Soil five plates with 1.5 grams of soil by brush. Dry for 8 minutes at 100° F. Meanwhile, charge the Hobart AM-14 with 1200 PPM of detergent solution (1452 grams of solution) and 121 grams of rice soil. After the plates are dried for 8 minutes, recharge the machine with the appropriate amount of detergent and soil (10.8 grams detergent for 1200-ppm detergent, 9.0 grams of soil for 2000 PPM food soil) and finally run through the second cycle. Resoil the same four plates, do not soil the fifth plate. Recharge the machine and run through a total of five cycles continuing to soil the same four plates. Allow the plates to dry for at least one hour, stain with $I_2$ and score. A five-cycle test typically requires two hours of preparation and run time.

One Cycle Test Results

| Detergent | 800 PPM | 1000 PPM | 1200 PPM | 1500 PPM |
|---|---|---|---|---|
| Formulation A | 57 | 62 | 68 | 63 |
| Formulation B | 57 | 62 | 57 | 68 |
| Formulation C | 55 | 62 | 62 | 62 |
| Formulation 1 | 60 | 60 | 60 | 60 |
| Formulation 2 | 65 | 60 | 60 | 60 |
| Formulation 3 | 60 | 70 | 70 | 70 |

Five Cycle Test Results

| Detergent | % Removal | Surface Tension (dynes) |
|---|---|---|
| Formulation A | 61 | NA |
| Formulation B | 63 | 25.63 |
| Formulation C | 78 | 28.10 |
| Formulation 1 | 85 | 23.60 |
| Formulation 2 | 85 | 21.28 |
| Formulation 3 | 90 | 23.46 |

Formulation A is a caustic based detergent composition available under the name Solid Power® from Ecolab, Inc. Formulation B is an ash based detergent composition.

We claim:

1. An alkaline detergent composition comprising:

(a) an effective soil removing amount of a source of alkalinity to provide the detergent with a pH of at least 10 when provided as a 1 wt. % aqueous solution; and (b) an effective soil-removing amount of a surfactant blend comprising:

(i) an alkyl polyglycoside surfactant; and (ii) a silicone surfactant comprising a hydrophobic silicone group and a pendant hydrophilic group having the formula:

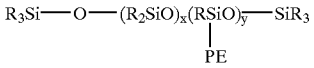

wherein PE represents $—CH_2—(CH_2)_p—O—(EO)_m(PO)_n—Z$, x is a number that ranges from about 0 to about 100, y is a number that ranges from about 1 to 100, p is 0 to 6, m and n are numbers that range from about 0 to about 50, m+n≧1, and Z represents hydrogen or R and each R independently represents a $C_{1-6}$ alkyl;

wherein the weight ratio of alkyl polyglycoside surfactant to silicone surfactant is between about 1:1 and about 20:1.

2. An alkaline detergent composition according to claim 1, wherein the surfactant blend further comprises a nonionic surfactant comprising a hydrophobic group and an $—(EO)_x$ group, wherein x is a number of about 1 to about 100.

3. An alkaline detergent composition according to claim 2, wherein the nonionic surfactant comprises an alkylethylene oxide-propylene oxide surfactant.

4. An alkaline detergent composition according to claim 2, wherein the silicone surfactant has the formula:

IV

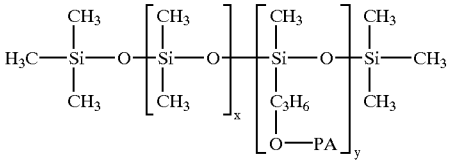

PA = $—(C_2H_4O)_a(C_3H_6O)_bR$ or

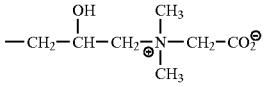

wherein x represent a number that ranges from about 0 to about 100, y represent a number that ranges from about 1 to about 100, a and b represent numbers that independently represent numbers that range from about 0 to about 60, a+b≧1 and R is hydrogen or a $C_{1-6}$ alkyl.

5. An alkaline detergent composition according to claim 1, wherein the silicone surfactant has the formula:

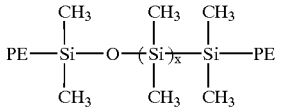

wherein PE represents $—CH_2—(CH_2)_p—O—(EO)_m(PO)_n—Z$, x is a number that ranges from about 0 to about 100, p is 0 to 6, m and n are numbers that range from about 0 to about 50, m+n≧1.

6. An alkaline detergent composition according to claim 1, wherein the composition comprises a polymer additive.

7. An alkaline detergent composition according to claim 6, wherein the polymer additive comprises a polycarboxylate polymer.

8. An alkaline detergent composition according to claim 1, wherein the alkyl polyglycoside surfactant has a degree of polymerization of between about 1 and about 4, and the alkyl group contains between about 6 and about 20 carbon atoms.

9. An alkaline detergent composition according to claim 1 wherein the source of alkalinity comprises an alkali metal hydroxide.

10. An alkaline detergent composition according to claim 1, wherein the source of alkalinity comprises an alkali metal carbonate.

11. An alkaline detergent composition according to claim 1, further comprising a hardness sequestering agent.

12. An alkaline detergent composition according to claim 11, wherein the hardness sequestering agent comprises at least one of amino carboxylic acid salts, phosphonic acid salts, and mixtures thereof.

13. An alkaline composition according to claim 11, wherein the hardness sequestering agent comprises at least one of amino trialkylene phosphonic acid salt; 1-hydroxyethylidene-1,1-diphosphonic acid salt; 2-phosphono-butane-1,2,4-tricarboxylic acid salt; and mixtures thereof.

14. An alkaline composition according to claim 11, wherein the hardness sequestering agent comprises aminotrimethylenephosphonic acid or salt thereof.

15. An alkaline detergent composition according to claim 2, wherein the nonionic surfactant comprises a capped linear alcohol ethoxylate.

16. An alkaline detergent composition according to claim 15, wherein the nonionic surfactant comprises a benzyl capped $C_{8-12}$ linear alcohol 6 to 16 mole ethoxylate.

17. An alkaline detergent composition according to claim 1, wherein the detergent comprises a solid block having a mass of at least 100 grams.

18. An alkaline detergent composition according to claim 17, wherein the detergent is packaged within a flexible wrapping.

19. An alkaline detergent composition according to claim 1, wherein the detergent is in the form of a powder.

20. An alkaline detergent composition according to claim 1, wherein the composition is in the form of a pellet.

21. An alkaline detergent composition according to claim 1, wherein the alkaline detergent composition comprises:

(a) about 5 to 65 wt % of $Na_2CO_3$; and (b) about 1 to 25 wt % of a hardness sequestering agent comprising at least one of sodium tripolyphosphate, and organic phosphonate sequesterant, and mixtures thereof.

22. A method for removing soil from an article, the method comprising:

(a) forming an aqueous detergent composition from a solid detergent composition, the solid detergent composition comprising:

(i) an effective soil removing amount of a source of alkalinity to provide the detergent with a pH of at least 10 when provided as a 1 wt. % aqueous solution; and (ii) an effective soil removing amount of a surfactant blend comprising an alkyl polyglycoside surfactant and a silicone surfactant, wherein the silicone surfactant includes a hydrophobic silicone group and a pendant hydrophilic group having the formula:

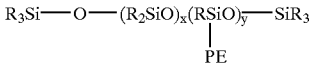

wherein PE represents $—CH_2—(CH_2)_p—O—(EO)_m(PO)_n—Z$, x is a number that ranges from about 0 to about 100, y is a number that ranges from about 1 to 100, p is 0 to 6, m and n are numbers that range from about 0 to about 50, m+n≧1, and Z represents hydrogen or R and each R independently represents a $C_{1-6}$alkyl; and (b) contacting an article surface containing starchy soil with the aqueous detergent composition.

23. A method for removing soil from an article according to claim 22, wherein said step of contacting comprises contacting the article with an aqueous detergent composition provided at a temperature of between about 120° F. and about 170° F.

24. A method for removing soil from an article according to claim 22, wherein the aqueous detergent composition comprises a nonionic surfactant comprising a hydrophobic group and an $—(EO)_x$ group, wherein x is a number of about 1 to about 100.

25. A method for removing soil from an article according to claim 22, wherein the aqueous detergent composition comprises a polymer additive.

26. A method for removing soil from an article according to claim 22, wherein the polymer additive comprises a polycarboxylate polymer.

27. A method for removing soil from an article according to claim 22, wherein the detergent composition is provided at a concentration of between about 500 ppm and about 2,000 ppm.

28. A method for removing soil from an article according to claim 22, wherein the detergent composition is provided at a concentration of up to about 5,000 ppm.

29. A method for removing soil from an article according to claim 22, wherein said article comprises dishware.

30. A method for removing soil from an article according to claim 22, wherein said article comprises laundry.

31. A method for removing soil from an article according to claim 22, wherein the aqueous detergent composition comprises a nonionic surfactant comprising alkyl-ethylene oxide-propylene oxide surfactant.

32. A method for removing soil from an article according to claim 22, wherein the silicone surfactant has the formula:

IV

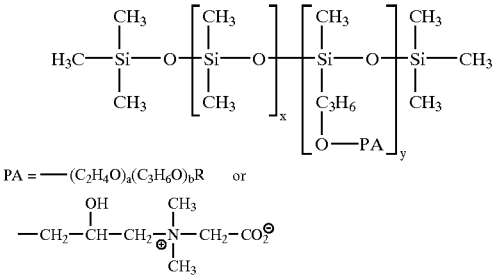

PA = —$(C_2H_4O)_a(C_3H_6O)_bR$ or wherein x represent a number that ranges from about 0 to about 100, y represent a number that ranges from about 1 to about 100, a and b represent numbers that independently represent numbers that range from about 0 to about 60, a+b≧1 and R is hydrogen or a $C_{1-6}$ alkyl.

33. A method for removing soil from an article according to claim 22, wherein the silicone surfactant comprises a surfactant having the formula:

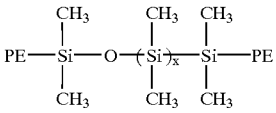

wherein PE represents —$CH_2$—$(CH_2)_p$—O—$(EO)_m$ $(PO)_n$—Z, x is a number that ranges from about 0 to about 100, p is 0 to 6, m and n are numbers that range from about 0 to about 50, m+n≧1.

34. A method for removing soil from an article according to claim 22, wherein said step of contacting comprises introducing the aqueous detergent composition into a machine warewashing apparatus.

35. A solid alkaline detergent composition comprising:

(a) an effective soil removing amount of a source of alkalinity to provide a detergent with a pH of at least 10 when provided as a 1 wt. % aqueous solution;

(b) a surfactant blend comprising:

(i) an alkyl polyglycoside surfactant; and (ii) a silicone surfactant comprising a hydrophobic silicone group and a pendant hydrophilic group having the formula:

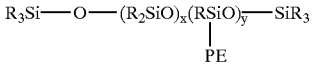

wherein PE represents —$CH_2$—$(CH_2)_p$—O—$(EO)_m(PO)_n$—Z, x is a number that ranges from about 0 to about 100, y is a number that ranges from about 1 to 100, p is 0 to 6, m and n are numbers that range from about 0 to about 50, m+n≧1, and Z represents hydrogen or R and each R independently represents a $C_{1-6}$ alkyl; and (c) a solidifying agent for solidifying the alkaline detergent composition.

36. A solid alkaline detergent composition according to claim 35, wherein the composition is in the form of an extruded block having a mass of at least 100 grams.

37. A solid alkaline detergent composition according to claim 35, wherein the composition is in the form of a powder.

38. A solid alkaline detergent composition according to claim 35, wherein the composition is in the form of a pellet.

39. A solid alkaline detergent composition according to claim 35, wherein the surfactant blend comprises:

(i) about 0.1 wt. % to about 30 wt. % alkyl polyglycoside surfactant; and (ii) about 0.05 wt. % to about 20 wt. % silicone surfactant.

40. A solid alkaline detergent composition according to claim 35, wherein the surfactant blend comprises:

(i) about 0.3 wt. % to about 4 wt. % alkyl polyglycoside surfactant; and (ii) about 0.3 wt. % to about 1 wt. % silicone surfactant.

41. A solid alkaline detergent composition according to claim 35, wherein the surfactant blend further comprises:

(i) about 0.1 wt. % to about 6 wt. % nonionic surfactant comprising a hydrophobic group and an $(EO)_x$ group, wherein x is a number from about 1–100.

* * * * *